United States Patent [19]

Rathert

[11] 4,198,048

[45] Apr. 15, 1980

[54] TOSSING GAME APPARATUS

[76] Inventor: Larry F. Rathert, 1527 Franklin Dr., Inkster, Mich. 48141

[21] Appl. No.: 845,499

[22] Filed: Oct. 26, 1977

[51] Int. Cl.[2] ..... A63B 67/06

[52] U.S. Cl. ..... 273/339

[58] Field of Search ..... 273/100, 104

[56] References Cited

U.S. PATENT DOCUMENTS

| | | | |
|---|---|---|---|
| 533,102 | 1/1895 | Thomson | 273/100 |
| 605,723 | 6/1898 | Klauder | 273/100 |
| 1,230,503 | 6/1917 | Miller | 273/100 |
| 1,372,770 | 3/1921 | Neville | 273/100 |
| 1,501,942 | 7/1924 | Carman | 273/100 |
| 1,617,127 | 2/1927 | Levay | 273/100 |
| 2,076,010 | 4/1937 | String | 273/100 |
| 2,996,976 | 9/1961 | Lewis | 273/100 |
| 3,421,762 | 1/1969 | Paradise | 273/104 |
| 3,507,496 | 4/1970 | Miller | 273/100 |
| 3,586,330 | 6/1971 | Lema | 273/100 |
| 3,823,942 | 7/1974 | Duncan | 273/104 |

*Primary Examiner*—William H. Grieb

*Attorney, Agent, or Firm*—Gifford, Chandler, VanOphem, Sheridan & Sprinkle

[57] ABSTRACT

A ring toss game is provided in which the target comprises a plurality of upwardly extending pegs mounted on a base. The base, in turn, is supported by a standard embedded in the ground. At least one peg is angled toward the center of the base, thereby increasing the difficulty of tossing a ring over the angled peg.

4 Claims, 3 Drawing Figures

TOSSING GAME APPARATUS

BACKGROUND OF THE INVENTION

I. Field of the Invention

The present invention relates to amusement devices and, more particularly, to a ring toss game.

II. Description of the Prior Art

Many games have been previously known in which aerial projectiles such as horsehoes, rings, darts and the like are thrown by contestants toward a target. Moreover, in the case of horseshoes or rings, the target is oftentimes a vertical post or peg supported by or driven into the ground. One disadvantage of these previously known games in which the peg is driven into the ground is that the force of the projectiles striking the peg causes the peg to loosen and thus lean away from its preferred vertical position. Similarly, in the previously known games in which the peg is merely set up on the ground, the projectiles oftentimes knock the peg over which interrupts the game.

A further disadvantage of these previously known games is that, since all the pegs are vertical, only a single degree of difficulty is provided for the player. Consequently, these previously known games become tedious after extended play.

A still further disadvantage of these previously known games, and particularly for horseshoes and darts, is that the projectiles can be dangerous if inaccurately or incorrectly thrown. As such, unsupervised play by children presents a serious safety hazard.

SUMMARY OF THE PRESENT INVENTION

The present invention overcomes these previously known disadvantages by providing a ring toss game in which the target is firmly, but detachably anchored to the ground and in which different degrees of playing difficulty are provided to the player.

In brief, the game apparatus of the present invention comprises a target having a base and a plurality of pegs extending upwardly from the base. A standard is secured at one end to the base while its other end is driven into the ground to firmly, but detachably, attach the target to the ground or playing area.

At least one of the pegs on the base is angled with respect to the other pegs which increases the difficulty of encircling the angled peg with a tossed ring. Thus, by awarding a different number of points in dependence upon which peg is encircled by the ring, a challenging game of skill is provided.

Preferably two targets are employed in the game and are placed at opposite ends of the playing area. Contestants stand at one end of the area. After the rings are all thrown, the players collect the rings and toss them toward the other target.

DESCRIPTION OF THE DRAWINGS

A better understanding of the present invention will be had upon reference to the following detailed description when read in conjunction with the accompanying drawing, wherein like reference characters refer to like parts throughout the several views and in which.

DETAILED DESCRIPTION OF THE INVENTION

Figure 1:
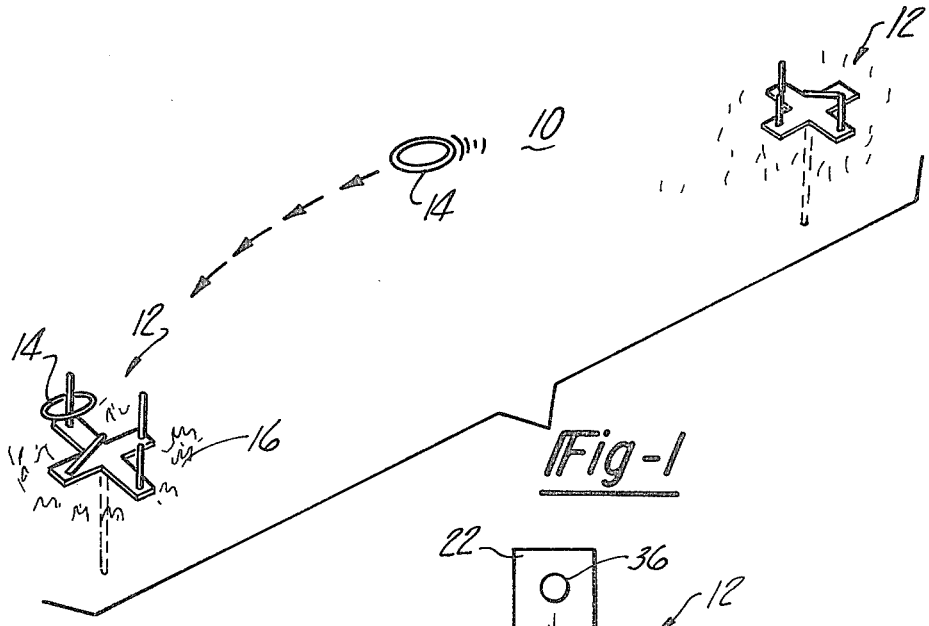
FIG. 1 is a perspective view of the game apparatus according to the present invention.

With reference first to FIG. 1, a game apparatus 10 according to the present invention is thereshown and comprises a pair of substantially identical targets 12 and a plurality of tossing rings 14. The targets 12 are positioned on a playing field 16 and are spaced from each other.

Figure 2:
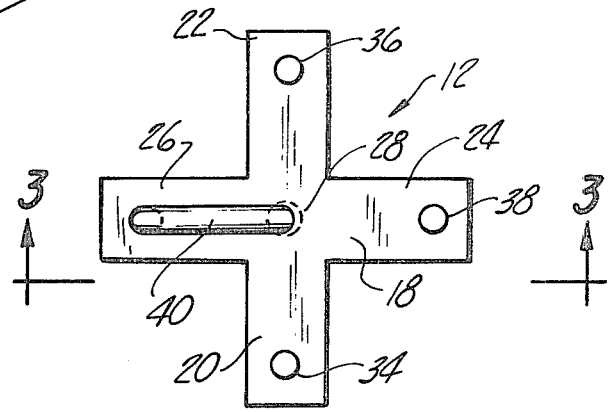
FIG.2 is a top plan view of one target of the game apparatus according to the present invention.
Figure 3:
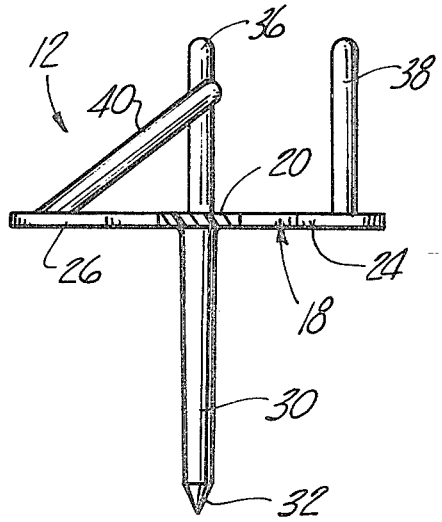
FIG. 3 is a partial sectional view of one target substantially along line 3—3 in FIG. 2.

With reference now to FIGS. 2 and 3, one target 12 is thereshown in greater detail and comprises a flat base 18. The base 18 is preferably cruciform in shape when viewed in plan and thus includes four portions 20, 22, 24 and 26 which protrude from the central portion 28 of the base 18.

An elongated standard 30 is secured at its upper end to the bottom of the base central portion 28 so that the standard 30 extends substantially perpendicularly away from the plane of the base 18. The opposite or lower end of the standard 30 is pointed at 32 so that the standard can be easily inserted into the ground or playing field 16 (FIG. 1). Upon doing so, the base 18 can either be elevated from the ground or flatly abut against the ground, as desired. A peg 34, 36, 38 and 40 is secured adjacent the free end of each protruding portion 20, 22, 24 and 26, respectively, of the base 18. The pegs 34, 36 and 38 extend generally vertically upwardly from the base 18. Conversely, the peg 40 is tilted or angled approximately 45 degrees toward the central portion 28 of the base 18. In addition, the vertical height of the tip of the peg 40 is less than the height of the tips of the other pegs 34, 36 and 38 for a reason to be shortly described.

As is best shown in FIGS. 2 and 3, the third and fourth pegs 34 and 36 are equidistantly spaced from the first and second pegs 38 and 40 but on opposite sides of the center line extending between said first and second pegs 38 and 40. In addition the other end of the second peg 40 extends at least to a center line extending between said third and fourth pegs 34 and 36.

Conversely, for indoor use a tripod (not shown) or the like can be used to support the target 12 upon the floor in lieu of the standard 30.

With reference now to FIG. 1, in play the standards 30 are inserted into the ground or playing field 16 so that the targets 12 are spaced from each other and so that the angled pegs 40 face each other. Thereafter, players stand adjacent one target 12 and attempt to toss the rings 14 onto and around the pegs 34, 36, 38 and 40 at the other target 12.

It is more difficult to project or toss one of the rings 14 around the peg 40 than the other pegs particularly since the peg 38 particularly blocks the entry to the peg 40. Consequently, a higher point value is preferably scored for tossing a ring 14 over the peg 40 than for the other pegs. In addition, a tossed ring 14 which leans against, but does not encircle, a peg is also preferably assigned a lower point value. A ring which leans, rather than encircles, a peg is difficult to obtain when the base 18 is elevated due to the cruciform shape of the base 18.

Although an integral construction of the target 12 is preferred, the pegs can be detachably connected to the base 18 so that pegs of varying heights to be used in order to vary the degree of difficulty of the game 10. Furthermore, the pegs, base and standard can be constructed of plastic, metal, wood or any suitable rigid material. It should also be apparent that by using the round tossing rings 14 as the projectiles, the previously known safety hazards of darts, horseshoes, and the like are completely avoided by the present invention.

Having described my invention, many modifications will become apparent to those skilled in the art to which it pertains without departing from the spirit of the invention as defined by the scope of the appended claims.

I claim:

1. A game apparatus comprising:

at least one target and, at least one ring adapted to be thrown at the target from a throwing area, wherein said target further comprises a base, means for attaching said base to a playing area, a first peg secured to said base and extending substantially vertically upwardly therefrom and a second peg secured at one end to said base at a position further spaced from said throwing area than said first peg, said peg being angled toward said first peg and wherein said first peg extends above the second peg so that the first peg partially blocks the entry of the ring to the second peg, a third and a fourth peg mounted to said base so that said third and fourth pegs extend generally vertically upwardly from the base, said third and fourth pegs being equidistantly spaced from said first and second pegs but on opposite sides of a center line extending between said first and second pegs, and wherein the other end of the second peg extends at least to a center line extending between said third and fourth pegs.

2. The invention as defined in claim 1 wherein said attaching means comprises an elongated standard having one end secured to the base and wherein the other end of the standard is pointed and adapted to be inserted into a playing field.

3. The invention as defined in claim 1 wherein the base is cruciform in shape having four outwardly extending portions and wherein one peg is secured adjacent the free end of each outwardly extending portion.

4. The invention as defined in claim 3 wherein two of the outwardly extending base portions are aligned with each other while the other two outwardly extending base portions are also aligned with each other, said first and second pegs being secured to one pair of aligned base portions and said third and fourth pegs being secured to the other pair of aligned base portions.

* * * * *

UNITED STATES PATENT AND TRADEMARK OFFICE

CERTIFICATE OF CORRECTION

PATENT NO. : 4,198,048

DATED : April 15, 1980

INVENTOR(S) : Larry F. Rathert

It is certified that error appears in the above-identified patent and that said Letters Patent are hereby corrected as shown below:

Column 2, line 54, delete "particularly" and insert --partially-- therefor.

Signed and Sealed this

*Twenty-sixth* Day of *August 1980*

[SEAL]

*Attest:*

SIDNEY A. DIAMOND

*Attesting Officer*

*Commissioner of Patents and Trademarks*